United States Patent [19]

Banes

[11] 4,080,668

[45] Mar. 28, 1978

[54] DUAL TOILET FLUSHING SYSTEM

[75] Inventor: Charles W. Banes, Winnemucca, Nev.

[73] Assignee: The Raymond Lee Organization, Inc., New York, N.Y. ; a part interest

[21] Appl. No.: 769,280

[22] Filed: Feb. 16, 1977

[51] Int. Cl.[2] ..... E03D 1/22; E03D 5/00; E03D 5/02

[52] U.S. Cl. ..... 4/325; 4/249

[58] Field of Search ..... 4/67 A, 67 R, 66, 34, 4/41, 52, 63, 61, 62, 249, DIG. 1, DIG. 3; 74/527, 528, 529; 251/12, 15, 20, 62

[56] References Cited

U.S. PATENT DOCUMENTS

| | | | |
|---|---|---|---|
| 2,046,888 | 7/1936 | Watt | 4/67 R |
| 2,963,710 | 12/1960 | Carter | 4/67 R |
| 3,143,894 | 8/1964 | Tennis | 74/528 |

FOREIGN PATENT DOCUMENTS

| | | | |
|---|---|---|---|
| 100,414 | 3/1937 | Australia | 4/67 R |
| 650,053 | 12/1962 | Italy | 4/67 A |

*Primary Examiner*—Henry K. Artis
*Attorney, Agent, or Firm*—Daniel Jay Tick

[57] ABSTRACT

A dual toilet flushing system provides a first volume of water for flushing when a handle is rotated to a first extent. The system provides a second volume of water, different from the first, when the handle is rotated to a second extent, different from the first.

1 Claim, 7 Drawing Figures

DUAL TOILET FLUSHING SYSTEM

BACKGROUND OF THE INVENTION

The present invention relates to a dual toilet flushing system. More particularly, the invention relates to a dual toilet flushing system for a water tank having a bottom, a top, a side with a bore formed therethrough in the area of the top, a water dump hole in the bottom of the water tank, a toilet, a water pipe from the water dump hole in the bottom of the water tank to the toilet and a handle member rotatably mounted in the bore through the side of the tank.

Objects of the invention are to provide a dual toilet flushing system of simple structure, which is inexpensive in manufacture, installed with facility and convenience in new and existing toilet facilities, requires little maintenance or upkeep, has a long useful life, and functions efficiently, effectively and reliably to provide either a first or a second different volume of water for flushing a toilet, thereby considerably saving water and water costs.

BRIEF DESCRIPTION OF THE DRAWINGS

In order that the invention may be readily carried into effect, it will now be described with reference to the accompanying drawings, wherein.

DETAILED DESCRIPTION OF THE INVENTION

Figure 1:
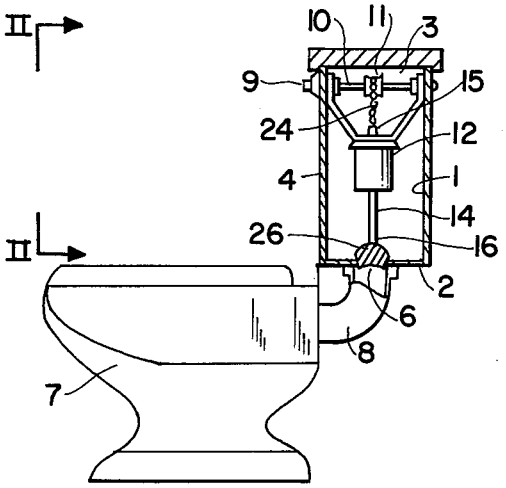
FIG. 1 is a side view, partly cut away and partly in section, of an embodiment of the dual toilet flushing system of the invention.
Figure 2:
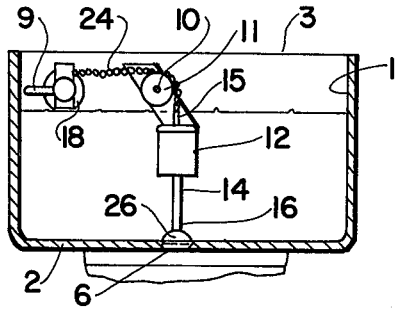
FIG. 2 is a view, taken along the lines II—II, of FIG. 1.

The dual toilet flushing system of the invention is for a water tank 1 (FIGS. 1 and 2) having a bottom 2 and a top 3 (FIGS. 1 and 2) and a side (FIGS. 1 and 4) having a bore 5 (FIG. 4) formed therethrough in the area of the top 3 of the tank. A water dump hole 6 is formed through the bottom 2 of the water tank 1, as shown in FIGS. 1 and 2. A toilet 7 is provided (FIG. 1). A water pipe 8 (FIG. 1) extends from the water dump hole 6 in the bottom of the water tank 1 to the toilet 7. A handle member 9 (FIGS. 1 to 4) is rotatably mounted in the bore 5 through the side 4 of the tank 1.

A shaft 10 (FIGS. 1 to 3 and 5) is rotatably mounted in the water tank 1 in the area of the top 3 thereof and extends transversely across the tank and across the water dump hole 6.

A first roller 11 (FIGS. 1 to 3 and 5) is affixed to the shaft 10 over the water dump hole 6 and is rotatable with said shaft.

Figure 6:
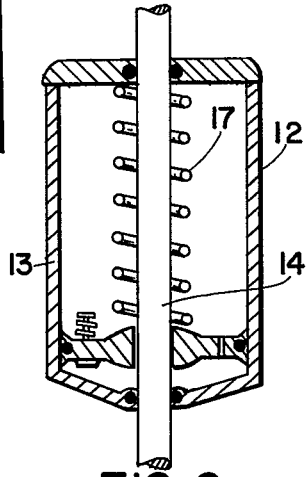
FIG. 6 is a view, on an enlarged scale, partly in section, of an embodiment of the hydraulic actuator of the dual toilet flushing system of the invention.
Figure 5:
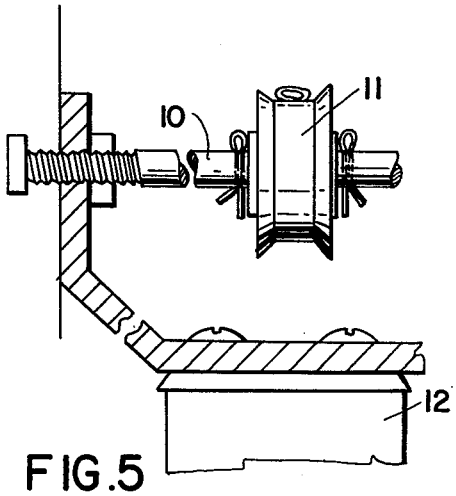
FIG. 5 is a view, on an enlarged scale, of some of the components of the embodiment of FIGS. 1 and 2.

A hydraulic actuator 12 of any suitable type (FIGS. 1, 2, 5 and 6) has a housing 13 in the tank 1 and a control shaft 14 (FIGS. 1 to 3 and 6) extending through the housing and having spaced opposite first and second ends 15 (FIGS. 1 to 3) and 16 (FIGS. 1 and 2) extending beyond the housing. A coil spring 17 (FIG. 6) is coaxially positioned around the control shaft 14 in the housing 13, as shown in FIG. 6, and moves the control shaft 14 downward toward the water dump hole 6 after the control shaft is moved upward.

A second roller 18 (FIGS. 2 to 4) is affixed to the handle 9 in the tank 1 and is rotatable therewith. The second roller 18 has a pair of spaced indentations 19 and 20 (FIG. 3) formed in its rim.

A detent ball 21 (FIGS. 3 and 4) is mounted at the rim of the second roller 18 in the tank 1. A detent spring 22 (FIGS. 3 and 4) urges the detent ball 21 radially toward the axis 23 (FIG. 3) of the second roller 18.

Figure 3:
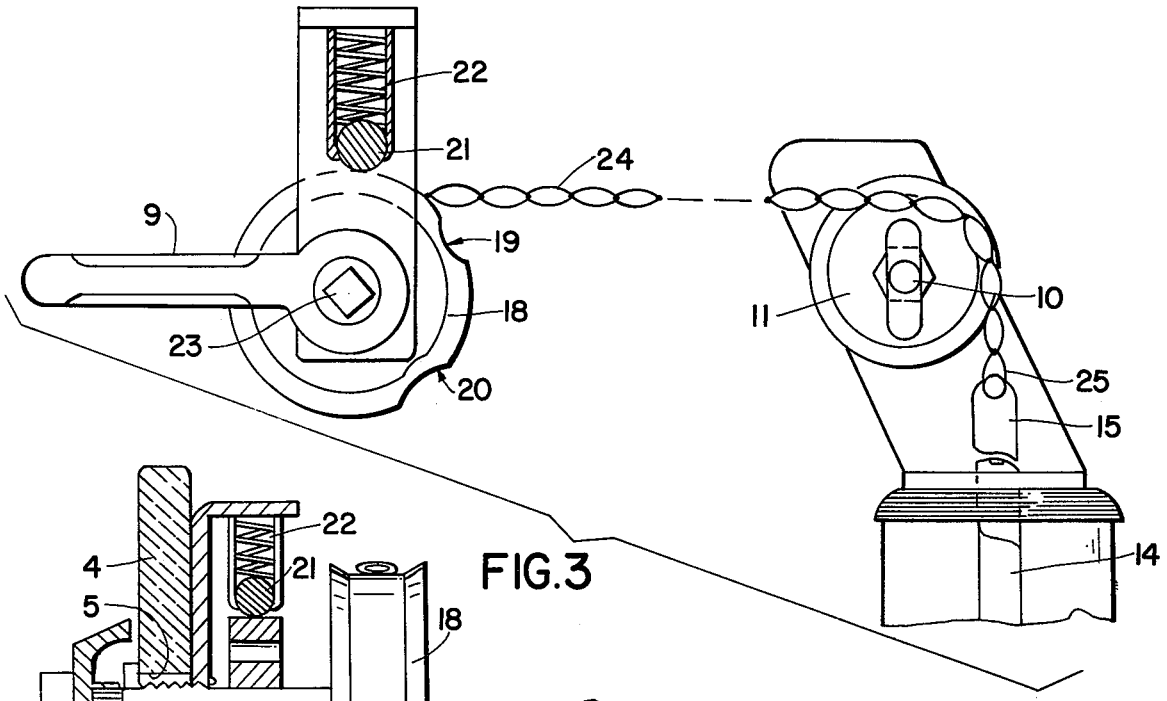
FIG. 3 is a view, on an enlarged scale, of some of the components of the embodiment of FIGS. 1 and 2.
Figure 4:
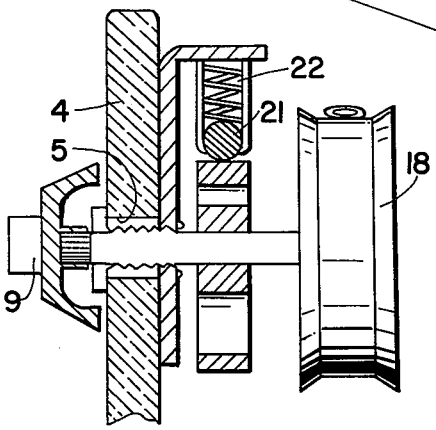
FIG. 4 is a view, partly in section, on an enlarged scale, of some of the components of the embodiment of FIGS. 1 and 2.
Figure 7:
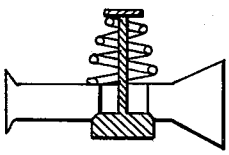
FIG. 7 is a view, on an enlarged scale, partly in section, of an embodiment of a bypass valve of the hydraulic actuator of FIG. 6.

A chain 24 (FIGS. 1 to 3) is wound on the second roller 18 and extends over the first roller 11, as shown in FIGS. 2 and 3. The chain 24 has a free end 25 affixed to the first end 15 of the control shaft 14, as shown in FIG. 3, whereby the control shaft hangs substantially vertically over the water dump hole 6.

A dump plug 26 (FIGS. 1 and 2) is affixed to the second end 16 of the control shaft 14, as shown in FIGS. 1 and 2.

When the handle 9 is turned counterclockwise until the detent ball 21 is moved by the detent spring 22 into a first of the indentations 19 in the rim of the second roller 18, the control shaft 14 is moved upward a first predetermined amount and moves the dump plug 26 a first predetermined distance above the water dump hole 6 whereby the spring 17 of the hydraulic actuator 12 moves the control shaft 14 downward to close said water dump hole with said dump plug after the lapse of a first period of time. This provides a first predetermined volume of flushing water through the water pipe 8 during the first period of time.

When the handle 9 is turned further counterclockwise until the detent ball 21 is moved by the detent spring 22 into the second of the indentations 20 on the rim of the second roller 18, the control shaft 14 is moved upward a second predetermined amount and moves the dump plug 26 a second predetermined distance above the water dump hole 6 greater than the first predetermined distance whereby the spring 17 of the hydraulic actuator 12 moves said control shaft upward to close said water dump hole with said dump plug after the lapse of a second period of time longer than the first period of time. This provides a second predetermined volume of flushing water greater than the first predetermined volume of flushing water through the water pipe 8 during the second period of time.

While the invention has been described by means of a specific example and in a specific embodiment, I do not wish to be limited thereto, for obvious modifications will occur to those skilled in the art without departing from the spirit and scope of the invention.

I claim:

1. A dual toilet flushing system for a water tank having a bottom, a top, a side having a bore formed therethrough in the area of the top, a water dump hole in the bottom of the water tank, a toilet, a water pipe from the water dump hole in the bottom of the water tank to the toilet and a handle member rotatably mounted in the bore through the side of the tank, said dual toilet flushing system comprising a shaft rotatably mounted in the water tank in the area of the top thereof and extending transversely across the tank and across the water dump hole;

a first roller affixed to the shaft over the water dump hole and rotatable with said shaft;

a hydraulic actuator having a housing in the tank, a control shaft extending through the housing and having spaced opposite first and second ends extending beyond the housing and a coil spring coaxially positioned around the control shaft in the housing and moving the control shaft downward toward the water dump hole after said control shaft is moved upward;

a second roller affixed to the handle in the tank and rotatable therewith, said second roller having a pair of spaced indentations formed in its rim;

a detent ball mounted at the rim of the second roller in the tank;

a detent spring urging the detent ball radially toward the axis of the second roller;

a chain wound on the second roller and extending over the first roller, said chain having a free end affixed to the first end of the control shaft whereby said control shaft hangs substantially vertically over the water dump hole; and a dump plug affixed to the second end of the control shaft whereby when the handle is turned until the detent ball is moved by the detent spring into a first of the indentations in the rim of the second roller, the control shaft is moved upward a first predetermined amount and moves the dump plug a first predetermined distance above the water dump hole whereby the spring of the hydraulic actuator moves the control shaft downward to close the water dump hole with the dump plug after the lapse of a first period of time thereby providing a first predetermined volume of flushing water through the water pipe during said first period of time, and when said handle is turned until said detent ball is moved by said detent spring into the second of the indentations in the rim of said second roller, said control shaft is moved upward a second predetermined amount and moves said dump plug a second predetermined distance above said water dump hole greater than said first predetermined distance whereby the spring of said hydraulic actuator moves said control shaft downward to close said water dump hole with said dump plug after the lapse of a second period of time longer than said first period of time thereby providing a second predetermined volume of flushing water greater than said first predetermined volume of flushing water through said water pipe during said second period of time.

* * * * *